United States Patent [19]

Levy

[11] Patent Number: 4,664,306

[45] Date of Patent: May 12, 1987

[54] TAG ATTACHER

[75] Inventor: Jon Levy, Fairfield, Conn.

[73] Assignee: Kwik Ticket, Inc., New York, N.Y.

[21] Appl. No.: 855,003

[22] Filed: Apr. 22, 1986

[51] Int. Cl.[4] ..... B25C 1/00; A41H 37/00

[52] U.S. Cl. ..... 227/67; 493/375; 221/74; 226/157

[58] Field of Search ..... 493/375, 376; 227/67; 226/157; 221/74; 222/391

[56] References Cited

U.S. PATENT DOCUMENTS

| | | | |
|---|---|---|---|
| 3,103,666 | 9/1963 | Bone . | |
| 3,650,451 | 3/1972 | Weiland et al. . | |
| 3,650,452 | 3/1972 | Finke . | |
| 3,652,004 | 3/1972 | Lozio . | |
| 3,659,769 | 5/1972 | Bone | 227/67 |
| 3,734,375 | 5/1973 | Bone et al. . | |
| 3,735,908 | 5/1973 | Kinney et al. . | |
| 3,759,435 | 9/1973 | Bone . | |
| 3,880,339 | 4/1975 | Bone . | |
| 3,888,402 | 6/1975 | Bone . | |
| 3,893,612 | 7/1975 | Bone . | |
| 3,895,753 | 7/1975 | Bone . | |
| 3,901,428 | 8/1975 | Grass . | |
| 3,906,611 | 9/1975 | Merser . | |
| 3,924,788 | 12/1975 | Furutu . | |
| 3,971,498 | 7/1976 | Bussard . | |
| 4,039,078 | 8/1977 | Bone . | |
| 4,040,555 | 8/1977 | Jenkins . | |
| 4,049,174 | 9/1977 | Hamisch, Sr. . | |
| 4,049,175 | 9/1977 | Hamisch, Sr. . | |
| 4,049,176 | 9/1977 | Jenkins . | |
| 4,049,178 | 9/1977 | Strausburg . | |
| 4,049,179 | 9/1977 | Jenkins . | |
| 4,090,653 | 5/1978 | Furutu . | |
| 4,121,487 | 10/1978 | Bone . | |
| 4,125,215 | 11/1978 | Jenkins . | |
| 4,179,063 | 12/1979 | Russell . | |
| 4,323,176 | 4/1982 | Sartain | 222/391 |
| 4,367,834 | 1/1983 | Lozio . | |
| 4,402,446 | 9/1983 | Suzuki . | |
| 4,416,407 | 11/1983 | Bone . | |
| 4,417,682 | 11/1983 | Furutsu . | |
| 4,437,854 | 3/1984 | Knoop | 493/353 |
| 4,456,162 | 6/1984 | Furutsu . | |
| 4,461,417 | 7/1984 | Furutsu . | |
| 4,482,088 | 11/1984 | Hyun . | |
| 4,502,622 | 3/1985 | Lee . | |
| 4,511,073 | 4/1985 | Furutsu . | |

OTHER PUBLICATIONS

A tag attacher gun bearing trademark SERGATEX.

*Primary Examiner*—Frederick R. Schmidt
*Assistant Examiner*—William E. Terrell
*Attorney, Agent, or Firm*—Ostrolenk, Faber, Gerb & Soffen

[57] ABSTRACT

A tag attacher for inserting tag fasteners into articles such as clothing or the like has a very simplified fastener advancing and positioning mechanism consisting entirely of a gear, a stopper adapted to permit unidirectional gear rotation and a one-piece gear advancer. The gear advancer which is operably connected to a main actuating lever of the tag attacher is V-shaped and includes a pin at the base of the V for making a hinged connection to the main lever, a pawl extending from the pin to the gear and a resilient arm which biases the pawl against the gear. The main lever also operates a sliding lever supporting a driving rod adapted for back and forth reciprocating movement. The driving rod pushes a lateral bar of the tag fasteners through a needle of the tag attacher into the article to be tagged.

15 Claims, 6 Drawing Figures

FIG. 3.
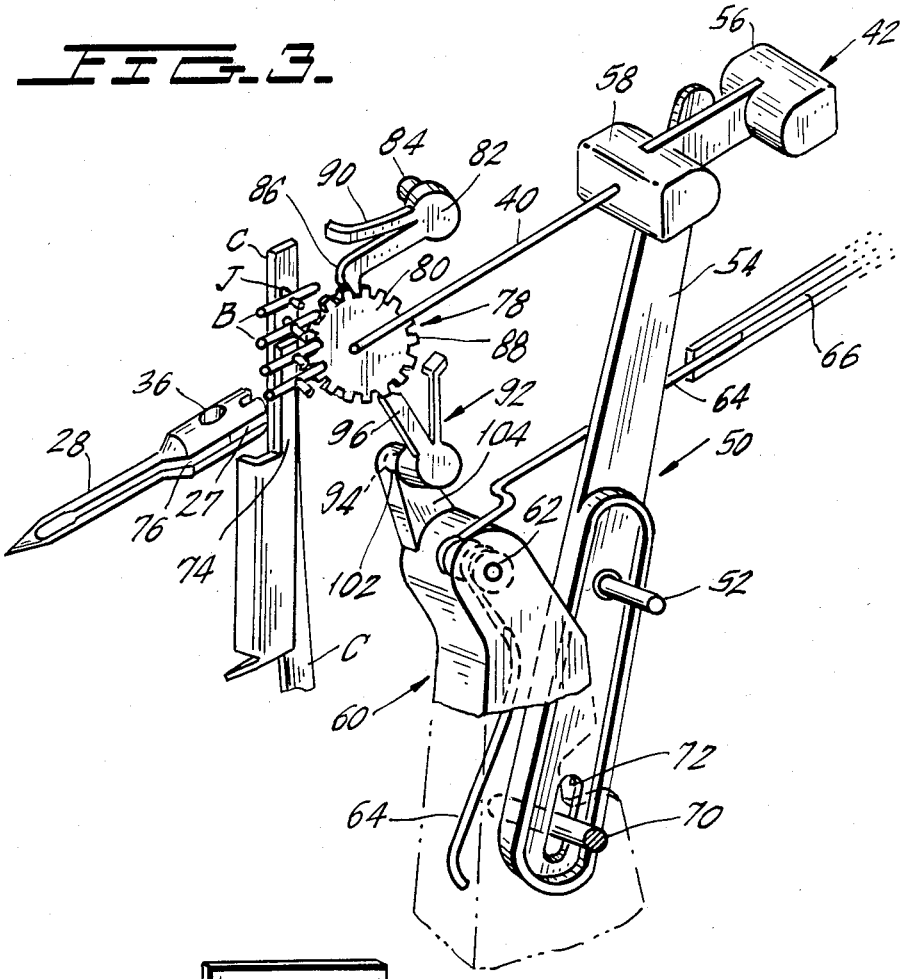
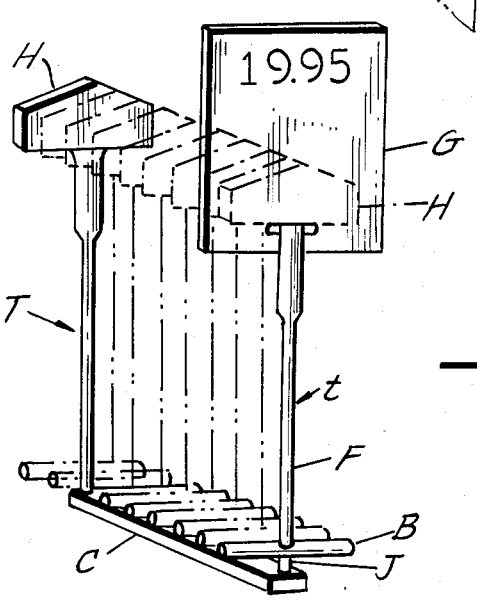
FIG. 6.
PRIOR ART

TAG ATTACHER

BACKGROUND OF THE INVENTION

The present invention relates to a tag attacher, and more particularly, to an improved tag attacher usable for applying a tag holding fastener to an article.

The art of tag attachers is well developed and numerous patents have been issued for devices of this type. Briefly, most tag attachers have a pistol-shaped housing with a handle supporting a lever. A hollow needle with a longitudinal slit which exposes the interior of the needle is mounted at the nozzle end of a housing for the tag attacher. A bar supporting a plurality of fasteners is inserted through the top of the tag attacher. Each actuation of the lever results in one fastener being pushed through the needle into the article and in another fastener being positioned against the needle.

Typically, the needle is inserted through a garment and the lever is actuated. Each fastener has a lateral bar which is positioned coaxially behind the needle. The lateral bar is pushed by a driving rod of the tag attacher through the hollow needle and emerges on the underside of the garment. The fastener remains locked when the needle is withdrawn. The other end of the fastener supports a tag displaying price, quality or other information.

Among the patents issued for tag attachers is U.S. Pat. No. 3,924,788 to Furutu. Furutu's tag attacher includes a gear for advancing the fasteners through the tag attacher; a stopper for constraining the gear to rotate in one direction only; a driving rod for pushing each fastener through the needle and first and second levers which are operable for reciprocatingly moving the driving rod as well as for advancing the gear one notch at a time. Furutu discloses a rather complicated gear advancing mechanism which includes a pawl that reciprocates generally transversely to the travel direction of the driving rod, a sliding rod which moves generally parallel to the driving rod and a cam for translating the horizontally directed movement of the sliding rod into the vertically directed movement of the gear advancing pawl.

Another similar tag attacher is shown in Furutu's U.S. Pat. No. 4,417,682 which adds an improved cutting mechanism for cutting sections from a connecting bar which holds the fasteners together. The cutting mechanism also secures and separates the individual fasteners from the connecting bar.

U.S. Pat. No. 3,759,435 to Bone shows a tag attacher, not of the familiar pistol shape, but including fastener advancing gear and a unique sickle-shaped pawl for advancing the gear one tooth at a time. The pawl is actuated by a sliding bar which moves substantially parallel to the direction of a driving bar or plunger which pushes the fasteners through a needle.

Yet another tag attacher is shown in U.S. Pat. No. 4,416,407 to Bone which is pistol-shaped and which operates in a manner similar to the previous tag attacher but includes a horizontally movable sliding bar for actuating the pawl which in turn advances the gear.

Another tag attacher is described in U.S. Pat. No. 4,040,555 to Jenkins. Again, the tagger requires a horizontally movable sliding bar for effecting movement of the gear.

Other patents relating to the subject matter of the present invention include:

| U.S. Pat. No. | Inventor | Date |
|---|---|---|
| 4,179,063 | Russell | 12/18/79 |
| 3,906,611 | Merser | 09/23/75 |
| 3,103,666 | Bone | 09/17/63 |
| 3,650,451 | Weiland et al. | 03/21/72 |
| 3,888,402 | Bone | 06/10/75 |
| 3,893,612 | Bone | 07/08/75 |
| 4,938,078 | Bone | 08/02/77 |
| 4,049,174 | Hamisch, Sr. | 09/20/77 |
| 4,049,175 | Hamisch, Sr. | 09/20/77 |
| 4,049,176 | Jenkins | 09/20/77 |
| 4,049,178 | Strausburg | 09/20/77 |
| 4,049,179 | Strausburg | 09/20/77 |
| 4,121,487 | Bone | 10/24/78 |
| 4,125,215 | Jenkins | 11/14/78 |
| 4,367,834 | Lozio | 01/11/83 |
| 4,402,446 | Suzuki | 09/06/83 |
| 3,650,452 | Finke | 03/21/72 |
| 3,652,004 | Lozio | 03/28/72 |
| 3,734,375 | Bone et al. | 05/22/73 |
| 3,735,908 | Kinney et al. | 05/29/83 |
| 3,880,339 | Bone | 04/29/75 |
| 3,895,753 | Bone | 07/22/75 |
| 3,901,428 | Grass | 08/26/75 |
| 3,971,498 | Bussard | 07/27/76 |

In addition to the foregoing, which generally use a horizontally movable sliding bar for advancing the gear, another tag attacher is known which does not use such a sliding bar in connection with the gear advancing mechanism. The gear is advanced by a vertically oriented arm which is resiliently biased against the gear by a spring which is, in turn, anchored against a wall in the housing for the tag attacher. The vertical arm is pulled up and down by a horizontally disposed piece which pivots in response to actuation of the lever contained in the handle to thereby reciprocate the vertical arm up and down to cause gear advancement. The tag attacher that is being described herein has been distributed several years ago by a foreign distributor and bears a mark SERGATEX.

As noted previously, the art of tag attachers is well developed. Competition in this field is keen and tag attachers which can be manufactured for well under $10.00 must be as simple and as reliable as possible to remain competitive. To date, all known tag attachers contain numerous parts including springs which renders assembly and repair of such tag attacher difficult. Internal parts tend to scatter in all directions when the gun is opened and the greater part count makes the tag attachers more expensive. Tag attacher designers constantly strive to reduce the part count and to simplify the mechanism in the tag attachers.

SUMMARY OF THE INVENTION

Accordingly, it is an object of the present invention to provide a tag attacher with the simplest mechanism.

It is another object of the present invention to provide a tag attacher which contains a minimum number of parts.

It is still another object of the present invention to provide a tag attacher which is inexpensive yet highly reliable.

It is a further object of the present invention to provide a tag attacher which can be easily assembled, disassembled and reassembled.

The tag attacher of the present invention meets the foregoing and other objects as it comprises a pistol-shaped housing assembled of two housing parts with a first part supporting the mechanism of the tag attacher and to a second part covering the first part and fixing the mechanism within.

A hollow needle is mounted at one end of the housing above a handle. A spring-loaded first lever protrudes from the handle and is coupled to a second lever disposed within the housing. The second lever is coupled to a driving rod or plunger which is movable into and out of the hollow needle. Each reciprocation of the first lever causes one tag fastener to be pushed through the needle into an article.

As a given tag fastener is pushed into the needle, a cutting blade located in the path into the needle severs the tag fastener from a connecting bar of a fastener assembly. The cutting blade is supported in a shaped channel in the housing and is accessible for periodic replacement upon becoming dulled.

A fastener advancing mechanism serves to advance the connecting bar of the tag fasteners through the housing to position the tag fasteners one-by-one against the needle in response to each actuation of the first lever. The mechanism includes a gear and a stopper which allows the gear to rotate in one direction only and in registration with a pointed end on an arm of the stopper. A one-piece gear advancer, preferably comprising a plastic molding, completes the fastener mechanism. The gear advancer is V-shaped and has two arms connected at the base of the V. One arm comprises a pawl that bears against the gear and the other arm resiliently biases the pawl against the gear. The base of the two arms defines a pin which fits into a depression in the first lever. As the first lever is depressed the pawl portion of the gear advancer is pulled away from a given gear tooth with which it presently meshes to one underneath it. When the lever returns to its original location the gear advancer is pushed upward, advancing the gear by one position.

Other features and advantages of the present invention will become apparent from the following description of the invention which description is elucidated by reference to the following drawings.

BRIEF DESCRIPTION OF THE DRAWINGS

FIG. 3 depicts perspectively the relationship between the needle feeding mechanism for the tag fasteners, the driving rod and the lever mechanism.

FIG. 6 shows a tag fastener assembly.

DETAILED DESCRIPTION OF A PREFERRED EMBODIMENT

Reference is made first to FIG. 6 which illustrates a tag fastener assembly that it used in conjunction with the tag attacher of the present invention. Familiarity with the various parts of tag fasteners will facilitate understanding of the mechanism of the tag attacher. Thus, tag fastener assembly T includes a plurality of tag fasteners "t" and a main connecting bar C to which each tag fastener "t" is connected. Each of fasteners "t" comprises a head portion H intended to supports a tag G, a connecting filament F, a lateral bar B which is pushed by the tag attacher of the present invention through an article and a joint portion J which connects the tag fastener t to connecting bar C. Joint portion J is severed during the insertion operation.

Figure 1:
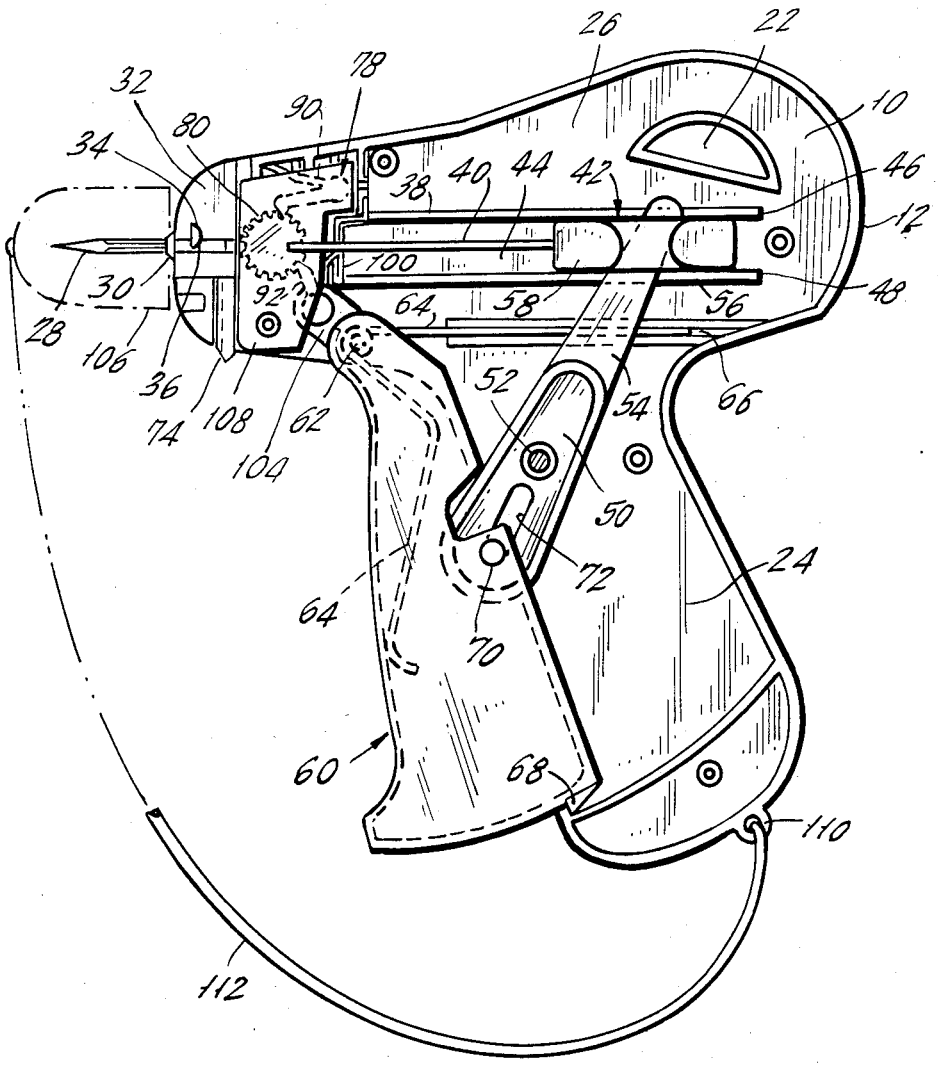
FIG. 1 is a side elevational view of a tag attacher of the present invention, with the cover portion of the housing removed.
Figure 2:
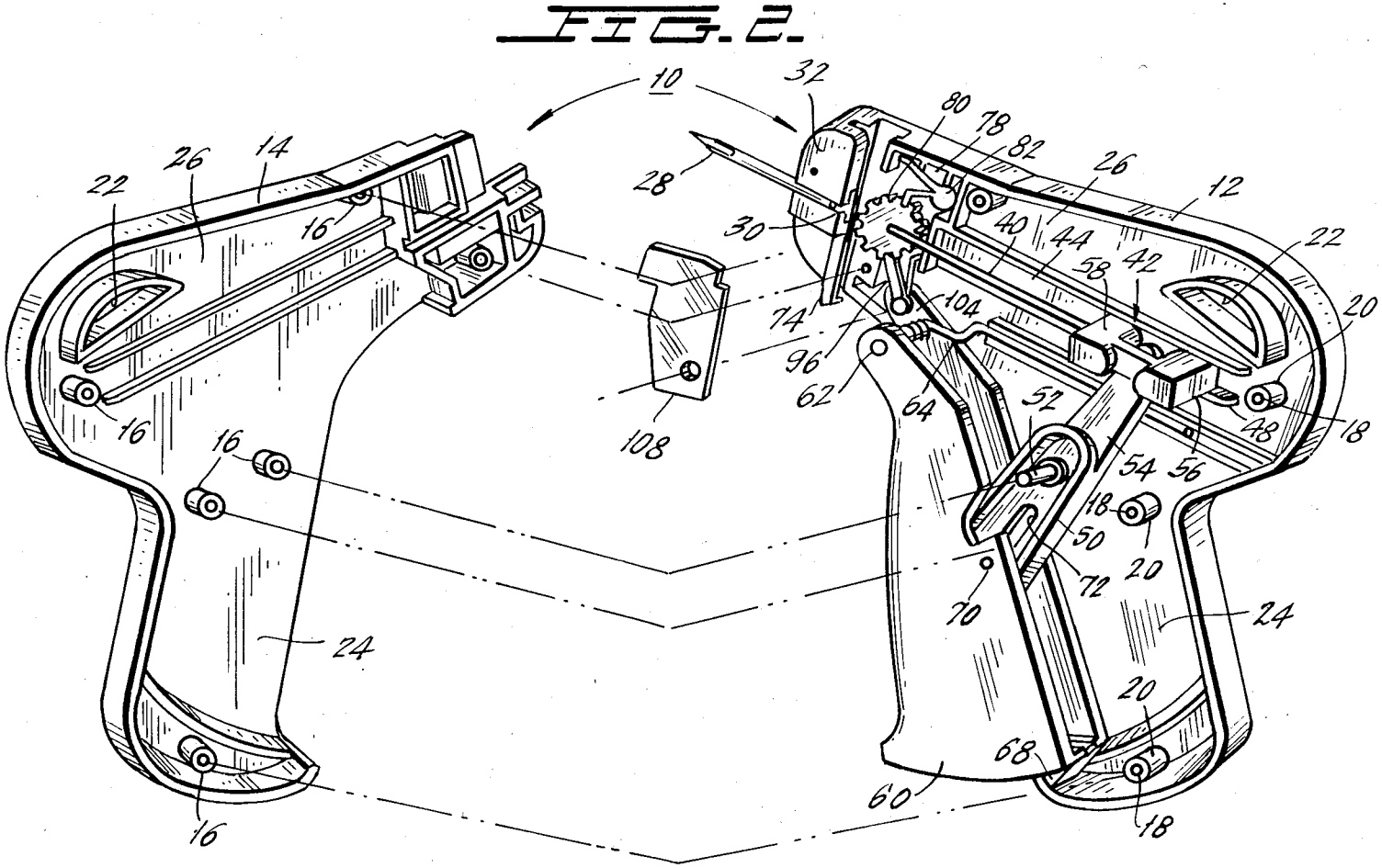
FIG. 2 shows the two halves of the housing disassembled.

Referring now to FIGS. 1 and 2, a pistol-shaped housing 10 is comprised of two molded housing halves including main housing half 12 and a cover portion 14. Housing halves 12 and 14 are fastened to each other by screws (not shown) which fit through holes 16 in cover portion 14 and are threaded into nuts 18 secured in posts 20 of main housing part 12. When housing parts 12 and 14 are fastened together they define an interior space for a tagger mechanism and a through-going hanging hole 22 by which the tag attacher can be hung on a hook, nail or the like. Each of the housing parts consists of a handle section 24 and a mechanism section 26 above the handle 24.

A hollow needle 28 is supported in a needle receiving opening 30 defined at one end 32 of mechanism section 26 in main housing part 12. Needle 28 is secured in place by rotatable lock 34, which engages a surface groove 36 in needle 28 in one position or allows a needle 28 to be removed, if desired, in another position. Driving rod assembly 38 comprises a metallic plunger 40 secured in an H-shaped plastic holder 42 which is disposed to slide back and forth in channel 44 defined by walls 46 and 48 of main housing part 12. Plunger 40 is aligned to slide in and out of hollow needle 28 in a manner that will push the lateral bar B (see FIG. 6) of fastener t through needle 28.

Figure 4:
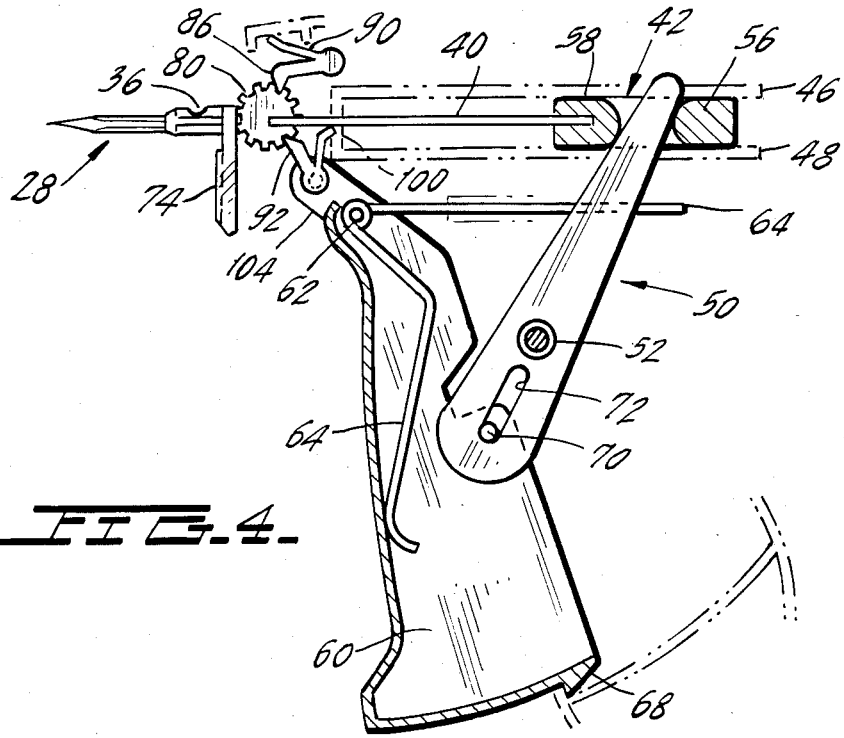
FIGS. 4 and 5, respectively, show the mechanism of the tag attacher with the main lever first undepressed and then in a depressed condition.
Figure 5:
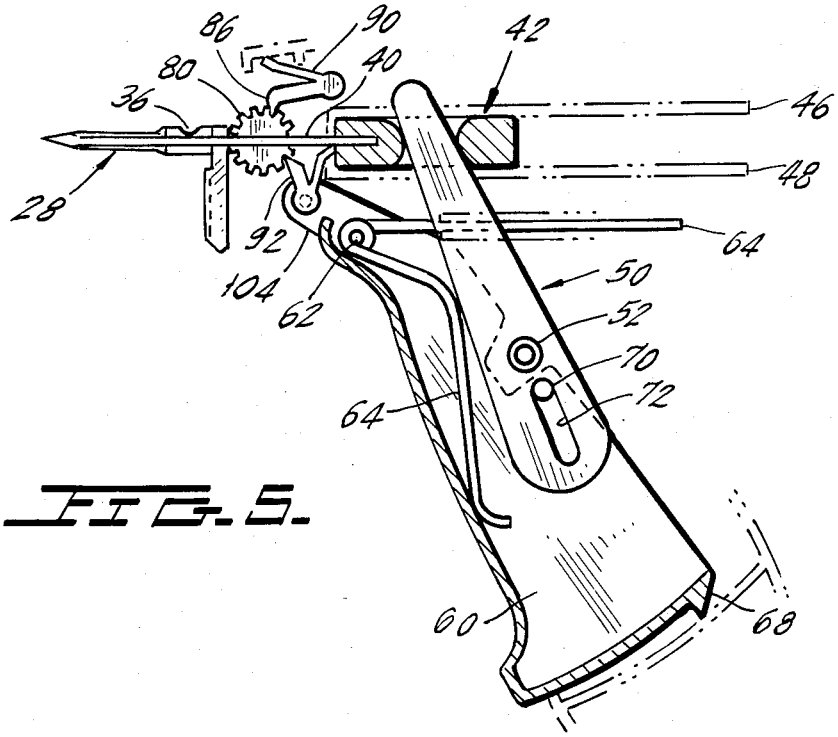

Slide lever 50 pivots about pin 52 which is secured in housing part 12, one end 54 of lever 50 being engaged between legs 56 and 58 of holder 42. As lever 50 pivots about pin 52, driving rod 38 slides back and forth in channel 44. Main lever 60 pivots about pin 62 and is normally biased to pivot clockwise by spring 64, one end of which is anchored in spring groove 66 of housing part 12. Each stop 68 at the bottom of main lever 60 retains the lever within housing 10. Coupling pin 70 located at about the center of main lever 60 rides in slot 72 of slide lever 50 causing the slide lever to pivot about its pin 52 in response to actuation of main lever 60. The pivoting range of slide lever 50 is depicted in FIGS. 4 and 5.

In operation, and as depicted in FIG. 3, tag fastener t whose lateral bar B is positioned against opening 27 into needle 28 will be pushed by plunger 40 into the needle as main lever 60 is depressed. As fastener t is pushed, its joint portion J is engaged by cutting blade 74 severing tag fastener "t" from connecting bar B as it enters needle 28. Note that slot 76 in needle 28 allows the filament portion F of the tag fastener to travel unobstructed through the needle. As main lever 60 is released, driving rod 38 returns to its original position and simultaneously a next in line tag fastener is positioned against opening 27 of needle 28 by means of fastener advancing mechanism 78.

Fastener advancing mechanism 78 comprises gear 80 with a bottom pin (not shown) received in a well formed in housing part 12 under gear 80, a stopper 82 which is fixed in position relative to the housing by shaft 84 and comprises a ratchet portion 86 which registers between teeth 88 of gear 80, allowing the gear to rotate only counterclockwise and in registration with ratchet portion 86. Resilient arm 90 of stopper 82 biases the stopper resiliently against gear 80. At the rest position, gear 80 is so positioned that the lateral bar B of a fastener is aligned precisely against the opening 27 into needle 28.

A one-piece, V-shaped, gear advancer 92 comprises a pin portion 94 forking into a pawl 96 and a resilient leaf spring 98 which is braced against wall 100 in main housing part 12. Pin portion 94 of gear advancer 92 is fitted in depression 102 in a short arm 104 of main lever 60.

Fastener advancing mechanism 78 operates as follows. As the main arm of main lever 60 is depressed, gear advancer 92 is pulled generally downwardly by short arm 104 as shown in FIG. 5 and snags gear 80 one tooth below its previous position. Although the downward movement of gear advancer 92 tends to rotate gear 80 clockwise, the gear remains in place locked by stopper 82. As main lever 60 is released, its short arm 104 will push gear advancer 92 upwardly, rotating gear 80 counterclockwise by one notch or one gear position. The pitch between adjacent tag fasteners on fastener assembly T matches the pitch on the teeth on gear 80 so that subsequent tooth movements of gear 80 result in fasteners t being positioned one-by-one against needle 28.

The above described fastener advancing mechanism consists entirely of three molded parts, namely gear 80, stopper 82 and gear advancer 92. There are no difficult to assemble springs. The mechanism is reliable, extremely inexpensive and durable. The location of the various components in the housing is self-evident, allowing the user to repair his tag attacher at will.

Fastener advancing mechanism 78 is covered by plate cover 108 seen in FIGS. 1 and 2. Needle cover 106, secured to eyelet 110 located at the bottom of housing part 12 by string 112 permits covering of needle 28 when the tagger is not in use.

Although the present invention has been described in connection with a specific embodiment thereof, many other variations and modifications will now become apparent to those skilled in the art. It is preferred, therefore, that the present invention be limited not by the specific disclosure herein, but only by the appended claims.

What is claimed is:

1. A tag attacher for inserting a lateral bar of a tag fastener into an article and for advancing a tag fastener assembly through said tag attacher to position the tag fasteners one after another in a position for being inserted, said tag attacher comprising:

a housing defining an interior space and a needle mounting opening at one end of said housing;

a needle having a bore therethrough detachably attached to said housing at said needle mounting opening;

a driving rod mounted for reciprocating movement in and out of said needle for pushing said lateral bar of said tag fastener through said needle;

a fastener advancing mechanism;

lever means for actuating said driving rod and said fastener advancing mechanism, said lever means comprising a main lever, and coupling means for moving said driving rod responsive to movement of said main lever;

said fastener advancing mechanism comprising:

a gear for feeding said tag fasteners one-by-one to said needle;

means for constraining said gear to rotate in one direction only;

a one-piece gear advancer located at an arm of said main lever, operably connected to said main lever for movement responsive to movement of said main lever, and having a pawl arm meshed with said gear and a spring arm for applying a resilient force to said pawl to maintain said pawl in mesh with said gear.

2. A tag attacher as in claim 1, wherein said coupling means comprises:

a slide lever operatively coupled to said driving rod for reciprocatingly moving said driving rod; and wherein said main lever has first and second arms, said first arm being positioned to be operated by a user, said first arm being operatively connected to said slide lever, said second arm being the arm at which said gear advancer is located.

3. A tag attacher as in claim 2, wherein said gear advancement arm of said main lever and said one-piece gear advancer are sized and so positioned that when said main lever is depressed inwardly, said pawl moves one tooth backward on said gear and when said main lever is released said pawl of said gear advancer moves in a direction to rotate said gear by one tooth position.

4. A tag attacher as in claim 1, wherein said one-piece gear advancer is V-shaped.

5. A tag attacher as in claim 4, wherein said gear advancer comprises a pin disposed at the base of said V-shaped gear advancer and said pin of said gear advancer is hinged in a depression defined on said arm of said lever.

6. The tag attacher of claim 5, wherein said lever comprises a pivoting pin and said lever is pivotable about said pivoting pin and said arm of said lever moves said one-piece gear advancer in a general direction which is transversely disposed to an axial direction of said needle.

7. The tag attacher of claim 6, including a spring for biasing said lever to an undepressed lever position.

8. The tag attacher of claim 1, wherein said driving rod comprises a metallic plunger disposed to engage said lateral bar of said tag fastener and a plunger holder, and wherein said main lever is user actuatable and said coupling means comprises a slide lever coupled to said main lever and to said driving rod, said slide lever including a pivoting pin hinged in said housing; a first arm part coupled to said driving rod; and a second arm part comprising a groove, said main lever further comprising a pin which extends through said groove in said slide lever whereby when said main lever is depressed, said driving rod is pushed into said needle and when said main lever is released, said slide lever is pulled by said main lever to pivot about its pivoting pin to cause said driving rod to be withdrawn from said needle.

9. The tag attacher as in claim 8, wherein said plunger holder of said driving rod is H-shaped and molded of a synthetic material.

10. The tag attacher of claim 1, wherein said housing comprises a main housing portion and a cover housing portion, the main housing portion supporting said lever means, said advancer mechanism, said needle and said driving rod of said tag attacher.

11. The tag attacher as in claim 10, wherein said main housing part comprises walls which define a sliding channel for said driving rod.

12. The tag attacher as in claim 1, which further comprises a cutting blade disposed adjacent an opening into said needle.

13. The tag attacher as in claim 12, wherein said cutting blade is removable and replaceable without dismantling of said housing.

14. The tag attacher as in claim 1, wherein the housing of said tag attacher is pistol-shaped and comprises a handle portion and a mechanism holding portion disposed above said handle portion.

15. The tag attacher of claim 1, in which said tag attacher comprises in its entirety a single metallic spring which metallic spring is effective for biasing at least a portion of said lever means outwardly of said housing.

* * * * *